United States Patent [19]

Matsuyama et al.

[11] 4,143,963

[45] Mar. 13, 1979

[54] DEVICE FOR CONTROLLING ROTATIONS OF PHOTOSENSITIVE DRUM FOR ELECTROGRAPHIC APPARATUS

[75] Inventors: Takashi Matsuyama, Hachioji; Hiroshi Tsuda, Mitaka; Muneo Kasuga, Hachioji, all of Japan

[73] Assignee: Olympus Optical Company Limited, Tokyo, Japan

[21] Appl. No.: 829,090

[22] Filed: Aug. 30, 1977

[51] Int. Cl.[2] ..... G03G 21/00

[52] U.S. Cl. ..... 355/14

[58] Field of Search ..... 355/3 R, 3 DR, 14

[56] References Cited

U.S. PATENT DOCUMENTS

| | | | |
|---|---|---|---|
| Re. 29,274 | 6/1977 | Collette et al. | 355/14 X |
| 3,669,412 | 6/1972 | Ogawa | 355/3 R |
| 3,731,874 | 5/1973 | Fowlie | 355/14 X |
| 3,819,261 | 6/1974 | Ogawa | 355/14 |
| 3,873,198 | 3/1975 | Ettelbrück et al. | 355/14 |
| 3,886,329 | 5/1975 | Kamiyama | 355/14 X |

*Primary Examiner*—A. D. Pellinen

*Attorney, Agent, or Firm*—Haseltine, Lake & Waters

[57] ABSTRACT

A device for controlling rotations of a photosensitive drum for electrographic apparatus. The device comprises a start button, a dial for setting number of copies to be reproduced, and means for rotating a photosensitive drum for turns corresponding to number of copies set beforehand plus 1 irrespective of setting said dial to positions corresponding to reproducing 1 copy and a plurality of copies.

4 Claims, 10 Drawing Figures

DEVICE FOR CONTROLLING ROTATIONS OF PHOTOSENSITIVE DRUM FOR ELECTROGRAPHIC APPARATUS

BACKGROUND OF THE INVENTION

This invention relates to a device for controlling rotations of a photosensitive drum for an electrographic apparatus.

In an electrographic apparatus which makes use of a photosensitive drum, it is necessary to rotate the photosensitive drum one turn in order to produce an electrostatic latent image thereon and then transfer such latent image to a record sheet. In this case, a step of producing the electrostatic latent image on the photosensitive drum must be effected independently of a step of transferring the electrostatic latent image to the record sheet. As a result, in the case of reproducing one or a plurality of copies from the electrostatic latent image produced on the photosensitive drum, the drum must be rotated for number of turns which is equal to number of copies set beforehand plus 1.

Many attempts have been made to provide a device which can rotate the drum for number of turns which is equal to number of copies set beforehand plus 1, but hitherto none has led to such devices which can satisfactorily control the rotations of the drum irrespective of the number of copies to be reproduced in a simple and reliable manner.

SUMMARY OF THE INVENTION

An object of the invention, therefore, is to provide a device for controlling rotations of a photosensitive drum for electrographic apparatus, which is so constructed and arranged that if a start button is pushed a photosensitive drum can be rotated for turns whose number is equal to number of copies set beforehand plus 1.

A feature of the invention is the provision of a device for controlling rotations of a photosensitive drum for electrographic apparatus, comprising means for setting numbers of copies to be reproduced to any desired number, means for rotating a photosensitive drum, a detection means for detecting number of turns of said photosensitive drum and delivering a signal, means receiving said signal from said detection means and subtracting the rotated number of said photosensitive drum from the number of copies set beforehand, and means for rotating said photosensitive drum for two turns and then stopping it when the number of copies set beforehand becomes 1.

DESCRIPTION OF THE PREFERRED EMBODIMENTS

Figure 1:
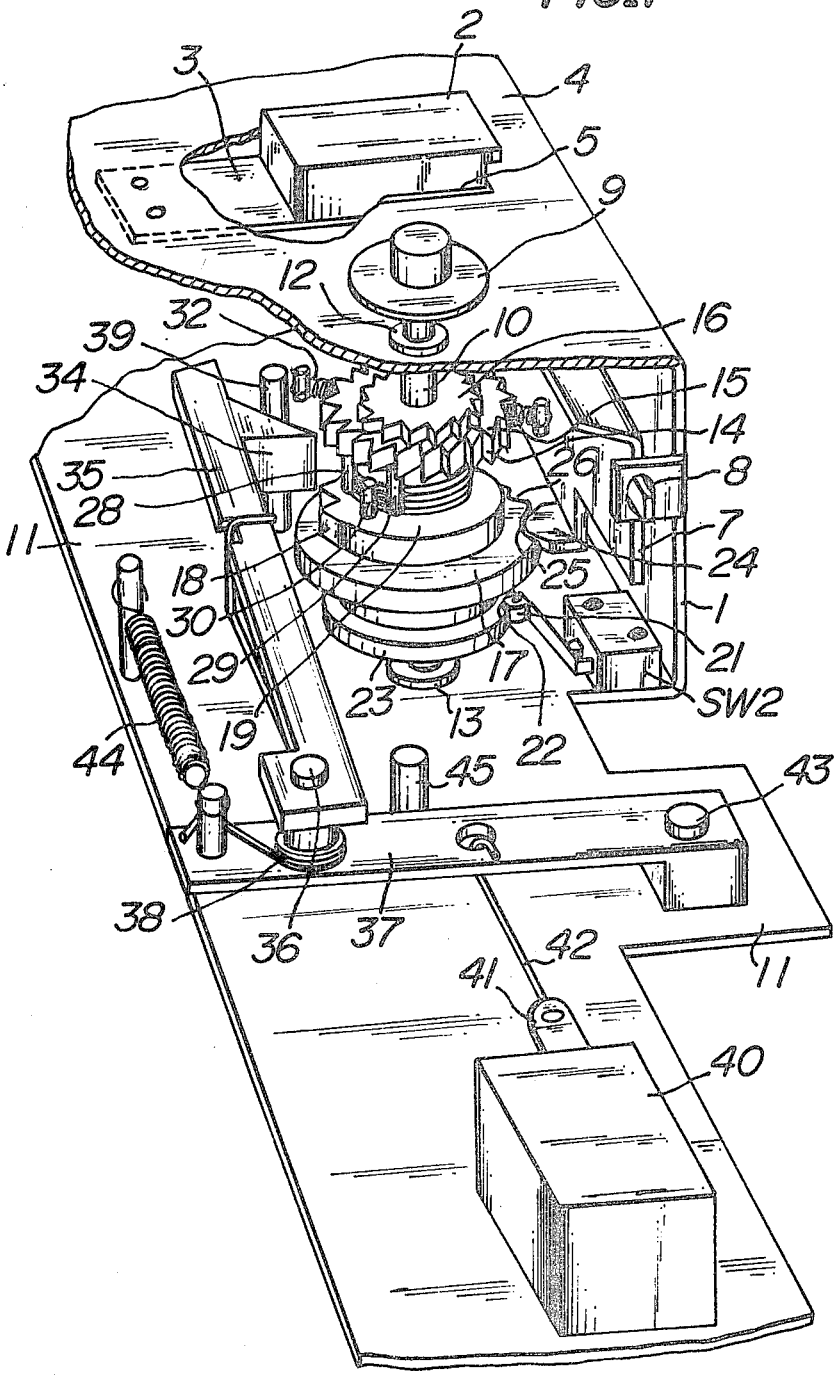
FIG. 1 is a perspective view of one embodiment of a device according to the invention, showing main parts thereof.

Referring to FIG. 1, reference numeral 1 designates a supporting frame constituting a part of an electrographic apparatus body or secured thereto. The supporting frame 1 is provided on its top plate 4 with a start button 2 secured through a leaf spring 3 thereto and resiliently projected therefrom through an opening 5 provided in the top plate 4.

Figure 2:
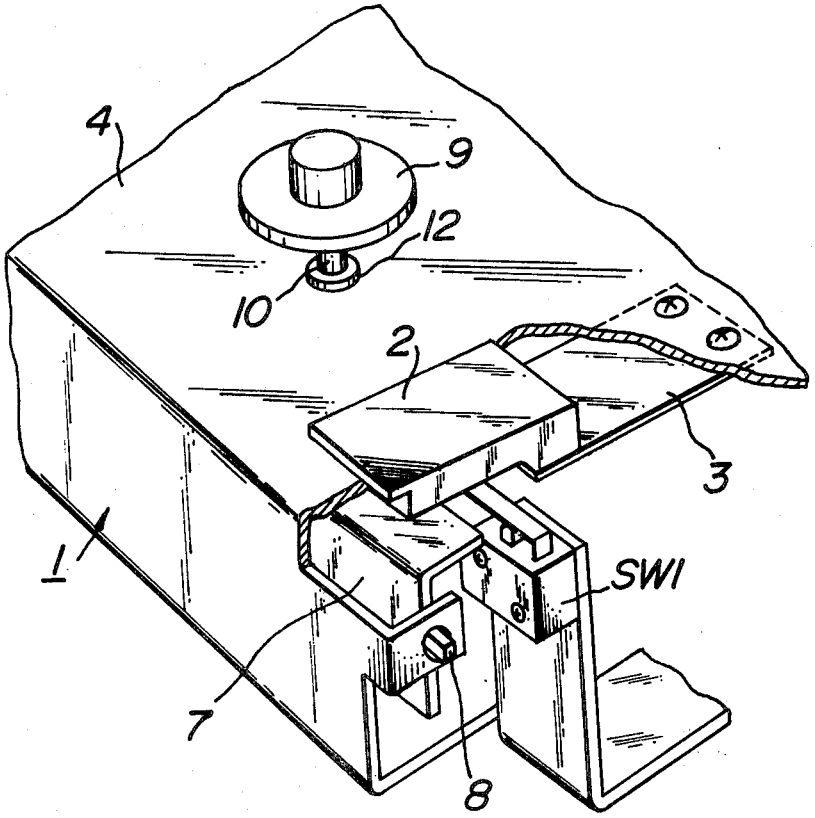
FIG. 2 is an enlarged perspective view showing a relation between a push button and a start switch.

As shown in FIG. 2, below the start button 2 are arranged a start switch SW1 and a rocking plate 7. The start switch SW1 is secured to the supporting frame 1 and becomes ON only when the start button 2 is pushed against the action of the leaf spring 3 and becomes OFF when the start switch 2 is released. The rocking plate 7 is rotatably supported by the supporting frame 1 by means of pivots 8 projected from each end of the supporting frame 1.

The supporting frame 1 is provided at its top plate 4 with a dial 9 for setting number of copies to be reproduced, and arranged side by side with the start button 2. The dial 9 is secured to a shaft 10 which is rotatably journaled in bearings 12, 13 provided on the top plate 4 and a base plate 11 of the supporting frame 1, respectively.

To the shaft 10 is secured a first ratchet wheel 15 with teeth 14 whose number is equal to the number of copies to be reproduced. To the upper face of the first ratchet wheel 15 is secured a click teeth 16 that may be engaged with a suitable click pawl which causes the click teeth 16 and the first ratchet wheel 15 to clamp and release at every one tooth thereof when the dial 9 is manually rotated.

Below the first ratchet wheel 15 are arranged a second ratchet wheel 19 and first and second cams 17, 23 which are freely engaged with the shaft 10. The second ratchet wheel 19 is provided with two teeth 18 only. The second cam 23 is provided at its outer periphery with a depression 22 which is engageable with a roller 21 of a stop switch SW2. The first cam 17 is provided at its outer periphery with two depressions 25, 26 which are engageable with a pawl 24 projected from the rocking plate 7.

In order to rotate the first cam 17 for two teeth relative to the first ratchet wheel 15, the first ratchet wheel 15 is provided at its lower surface with two pins 28, 29 downwardly projected therefrom and circumferentially spaced apart from each other by a distance which corresponds to the two teeth of the first ratchet wheel 15. Between these two pins 28, 29 is located a pin 30 projected from the upper surface of the second ratchet wheel 19, and coaxially arranged with these two pins 28, 29. Around the shaft 10 is wound a torsion spring 31, FIGS. 3–5, having ends secured to the pins 28 and 30, respectively.

Figure 3:
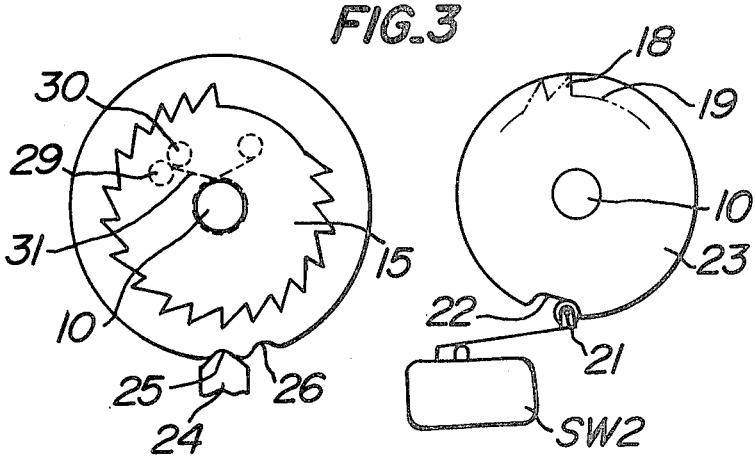
FIGS. 3 to 5 are fragmentary views illustrating successive operational positions of first and second ratchet wheels and first and second cams.
Figure 7:
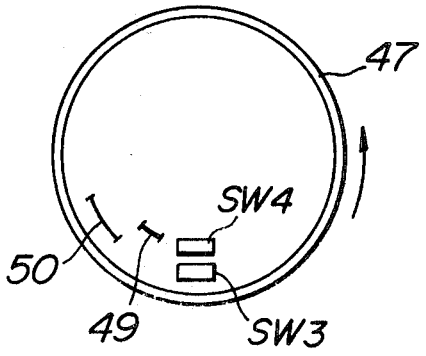
FIG. 7 is an end view of a photosensitive drum.

In FIG. 3 is shown a stop position of a photosensitive drum 47 shown in FIG. 7. In this stop position, if the start button 2 is pushed to rotate the rocking plate 7 about its pivot 8 against the action of a spring 32, the pawl 24 is disengaged from the depression 25 of the first cam 17. The torsion spring 31 functions to rotate the first cam 17 in a clockwise direction for a distance corresponding to two teeth of the first ratchet wheel 15 and urge the pin 30 against the pin 28 as shown in FIG. 4.

Figure 4:
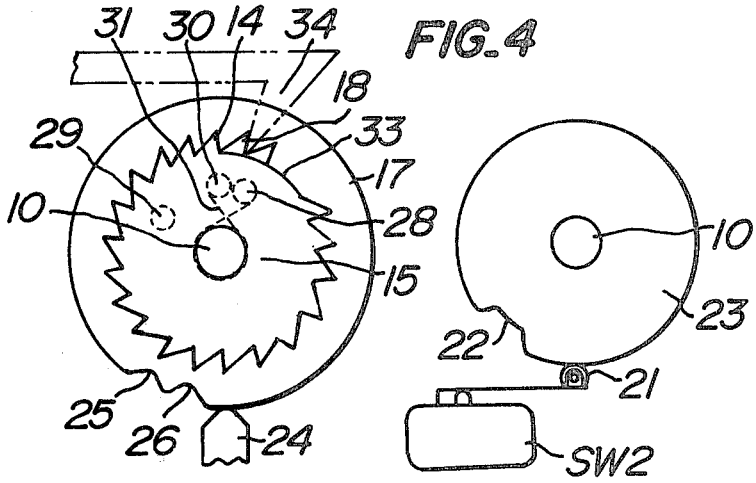
Figure 5:
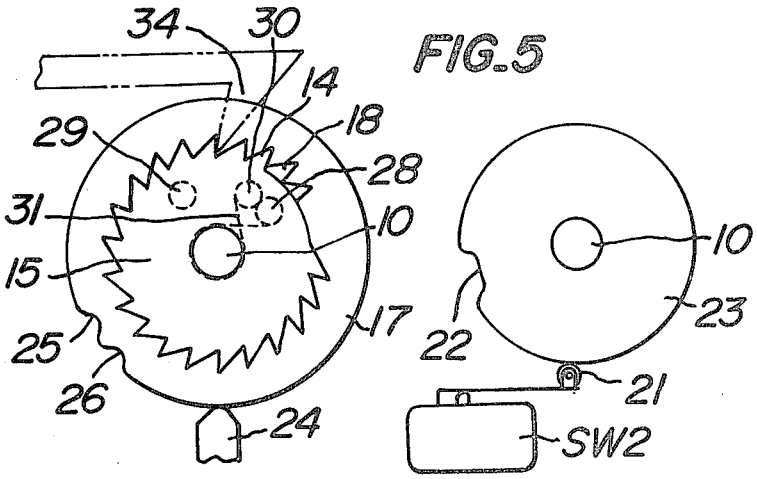

As shown in FIGS. 3 to 5, the first ratchet wheel 15 is provided with a tooth absent portion 33. A relative position between the dial 9 and the first ratchet wheel 15 on the one hand and a relative position between the pins 28, 29 of the first ratchet wheel 15 and the pin 30 of the second ratchet wheel 19 on the other hand are suitably selected such that a number 1 indicated on the dial 9 and defining the number of copy to be reproduced is brought into agreement with the first tooth 14 of the first ratchet wheel 15, and that, if the first cam 17 is rotated from its locked position shown in FIG. 3 to its released position shown in FIG. 4, the two teeth 18 of the second ratchet wheel 19 made integral with the first cam 17 arrive at the teeth absent portion 33 of the first ratchet wheel 15 as shown in FIG. 4 so as to make the two teeth 18 continuous with the teeth 14 of the first ratchet wheel 15.

Provision is made of a counter step mechanism composed of a return arm 35 pivotally mounted through a pin 36 on a lever 37. The return arm 35 is provided at its free end with a claw 34 engageable with the teeth 14, 18 of the first and second ratchet wheels 15, 19. Around the pin 36 is wound a spring 38 for urging the return arm 35 against a stopper 39. The lever 37 is connected at its center through a hook 42 and an operating piece 41 to a solenoid 40 and pivoted at its one end through a pivot pin 43 to the base plate 11. The other end of the lever 37 is connected through a tension spring 44 to the base plate 11. The tension spring 44 functions to rotate the lever 37 about the pivot pin 43 in a clockwise direction, that is, functions to pull out the operating piece 41 from the solenoid 40 and urge the lever 37 against a stopper 45. When the solenoid 40 is energized, the lever 37 is pulled toward the solenoid 40 against the action of the tension spring 44 so as to bring the claw 34 into engagement with the teeth 14 of the first ratchet wheel 15 or with the teeth 18 of the second ratchet wheel 19, whereby the first ratchet wheel 15 or the second ratchet wheel 17 is rotated in a counterclockwise rotation for a distance corresponding to one tooth thereof.

The operation of the device constructed as above described according to the invention will now be described.

In the case of reproducing one copy only, the device will operate as follows. The dial 9 is usually set such that its graduated numeral "1" is aligned with a pointer, that is, the dial 9 is set to the number "1". As a result, in the case of reproducing one copy only, the dial 9 is not rotated. A manuscript to be copied is placed on a reciprocating carriage and then the start button 2 is pushed to make the switch SW1 ON. At the same time, the rocking plate 7 is rotated against the action of the spring 32 to disengage the pawl 24 from the depression 25 as shown in FIG. 4, and as a result, the torsion spring 31 causes the second ratchet wheel 19 to rotate about the shaft 10 in a clockwise direction relative to the first ratchet wheel 15 until the pin 30 engages the pin 28 as shown in FIG. 4. The two teeth 18 of the second ratchet wheel 19 are located in the tooth absent portion adjacent to the teeth 14 of the first ratchet wheel 15. At the same time, the roller 21 becomes disengaged from the depression 22 of the second cam 23 to make the switch SW2 ON.

If an operator's finger is released from the start button 2, the spring 3 causes the start button 2 to return to its original position. As a result, the switch SW1 becomes OFF. But, since the roller 21 engages with the outer periphery of the second cam 23, the switch SW2 is kept in its ON condition.

Figure 6:
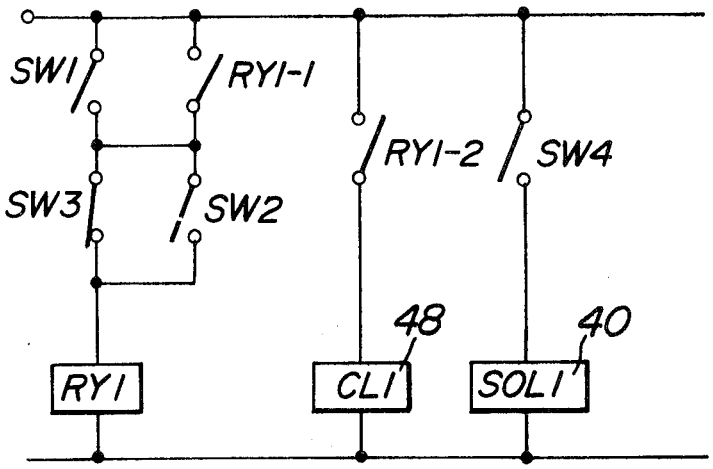
FIG. 6 is a simplified illustration of an electrical circuit that may be employed to drive a photosensitive drum.

If the switches SW1, SW2 become ON, a relay RY1 shown in FIG. 6 is energized to close relay contacts RY1-1, RY1-2, respectively. As a result, even when the start switch SW1 becomes OFF, the relay contact RY1-1 connected in parallel with the switch SW1 and kept closed functions to maintain the relay RY1 in its energized condition. If the relay contact RY1-2 is closed, a solenoid 48 for operating a clutch CL1 for rotating the photosensitive drum 47 shown in FIG. 7 is energized to rotate the drum 47 which is then exposed and scanned by the manuscript image to produce an electrostatic latent image thereon.

The drum 47 is provided at its side surface with first and second operating pieces 49 and 50. When the drum 47 is rotated, the first operating piece 49 makes contact with a counter step switch SW4 to make it ON. As a result, a solenoid SOL1 (40) is energized to operate the counter step mechanism shown in FIG. 1.

That is, when the solenoid SOL1 (40) is energized, the claw 34 becomes engaged with one of the teeth 18 as shown in FIG. 4 so as to rotate the second ratchet wheel 19 by one tooth in a counterclockwise direction. This counterclockwise rotation of the second ratchet wheel 19 becomes stopped when the pawl 24 becomes engaged with the depression 26 of the first cam 17 by the action of the spring 32.

In this way, the second ratchet wheel 19 is returned by one tooth 18 to terminate one turn of the drum 47.

At the end of one turn of the drum 47, the second operating piece 50 secured to the side surface of the drum 47 becomes engaged with a normally closed stop switch SW3 to make it OFF. But, since the switch SW2 is kept under its ON condition, the drum 47 still continues its rotation.

Near the end of the second rotation of the drum 47, the first operating piece 49 becomes engaged with the switch SW4 to make it ON again. As a result, the solenoid (SOL1) 40 is energized again to cause the claw 34 to engage with the remaining tooth 18 of the second ratchet wheel 19, thereby rotating it in a counterclockwise direction again. Thus, the depression 25 of the first cam 17 is returned to its start position shown in FIG. 3 where the pawl 24 engages with the depression 25. As a result, the roller 21 becomes engaged with the depression 22 to make the switch SW2 OFF.

In this case, the relay RY1 is still energized through its self-holding contact RY1-1 and the normally closed switch SW3, so that the drum 47 still continues its rotation. At the end of the second rotation of the drum 47, the second operating piece 50 becomes engaged with the normally closed stop switch SW3 so as to make it OFF. As a result, the relay RY1 becomes OFF to stop the rotation of the drum 47.

As seen from the above, since the switch SW2 is kept under its ON condition until the solenoid 40 operates two times, it is possible to rotate the drum 47 for two turns for the purpose of reproducing one copy.

Next, the operation of the device in the case of reproducing a plurality of copies will be described. The dial 9 is rotated such that its desired graduated number n is aligned with a pointer. The rotation of the dial 9 results in rotation of the first ratchet wheel 15 secured to the shaft 10 against the click teeth 16. The pin 29 of the first ratchet wheel 15 becomes engaged with the pin 30 of the second ratchet wheel 19 to rotate also the latter. If the second ratchet wheel 19 is rotated, the depression 26 is disengaged from the pawl 24 against the action of the spring 32. The torsion spring 31 is made stronger than the frictional force between the pawl 24 and the outer periphery of the first cam 17, so that the torsion spring 31 causes the second ratchet wheel 19 to rotate relative to the first ratchet wheel 15 and causes the pin 30 to engage with the pin 28 as shown in FIG. 5. As a result, the roller 21 for operating the switch SW2 is disengaged from the depression 22 to make the switch SW2 ON. In this case, the start switch SW1 is not yet pushed, so that the relay RY1 is not energized and the device is inoperative.

Then, if the start button 2 is pushed, the start switch SW1 becomes ON to close the relay contact RY1-1. As a result, even when the start switch SW1 becomes OFF again, it is possible to remain the relay RY1 under its energized condition by its self-holding contact RY1-1. At the same time, the relay contact RY1-2 is closed to energize the solenoid 48 for operating the clutch CL1 for driving the drum 47, thereby rotating the drum 47.

At near the end of one turn of the drum 47, the first operating piece 49 causes the counter step switch SW4 to make ON to energize the solenoid SOL1 (40). As a result, the claw 34 becomes engaged with one tooth 14 of the first ratchet wheel 15 as shown in FIG. 5 to rotates it for a distance corresponding to one tooth.

In similar manner, the drum 47 is continuously rotated. After the first ratchet wheel 15 has been rotated for number of turns which is equal to the number of copies set beforehand, the first ratchet wheel 15 arrives at that position shown in FIG. 4 which is described above in the case of reproducing one copy only. Then, the claw 34 becomes engaged with the first tooth 18 of the second ratchet wheel 19 to rotate it against the action of the torsion spring 31. As a result, let the number of copies set beforehand be n, then the number of turns N of the drum 47 becomes $N=n+1$.

Figure 8:
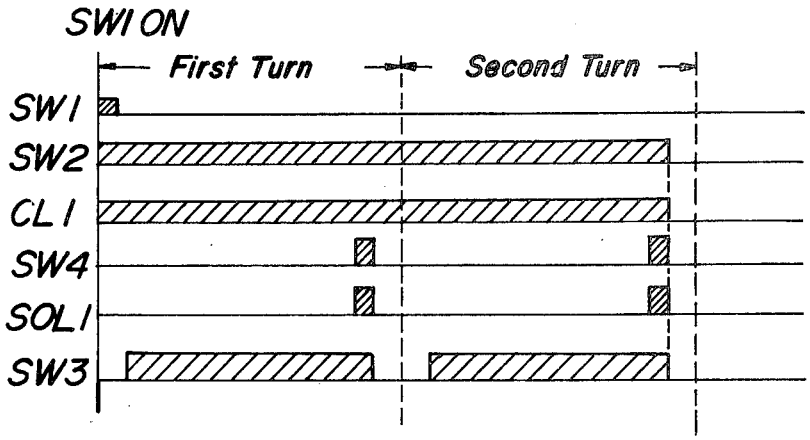
FIG. 8 is a diagram illustrating successive operations of various switches and solenoids for operating a photosensitive drum in the case of reproducing one copy only.

In FIG. 8 is shown a diagram illustrating successive operations of various switches for operating the photosensitive drum 47 in the case of reproducing one copy only. In the first place, let it be assumed that the drum 47 is stopped at such position that the normally closed stop switch SW3 is ON and that the solenoid CL1 (48) is deenergized.

If the start button 2 is pushed, the switches SW1, SW2 becomes ON to energize the relay RY1. As a result, the self-holding contact RY1-1 connected in parallel with the start switch SW1 is closed. Thus, even when the start switch SW1 becomes OFF, the relay RY1 is maintained under its energized condition through the self-holding contact RY1-1. At the same time, the second relay contact RY1-2 is closed to energize the solenoid 48 for operating the clutch CL1 and rotate the cylinder 47.

As described above, the stop switch SW2 becomes ON when the start button 2 is pushed and is kept under its ON position until the counter step switch SW4 becomes operated two times, that is, until the solenoid SOL1 (40) is energized two times.

As shown in FIG. 6, the stop switches SW3 and SW2 are connected in parallel, so that even when the switch SW3 becomes OFF at the end of one turn of the drum 47, the relay RY1 is energized through the switch SW2, thereby continuing rotation of the drum 47. At near the end of the second turn of the drum 47, the counter step switch SW4 becomes ON to rotate the second ratchet wheel 19 to the position shown in FIG. 3, thereby making the switch SW2 OFF. At the end of the second turn of the drum 47, the second operating piece 50 engages with the stop switch SW3 to make it OFF, thereby deenergizing the relay RY1 and opening the relay contact RY1-2. As a result, the solenoid 48 for operating the clutch CL1 is deenergized to stop the drum 47. In this way, the stop switch SW2 is made ON until the counter step solenoid SOL1 (40) is energized two times. Thus, it is possible to rotate the drum 47 for two turns in the case of reproducing one copy only.

Figure 9:
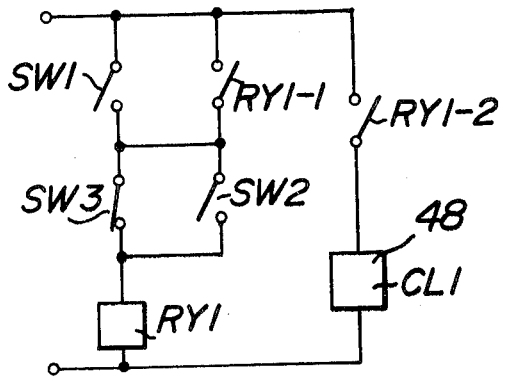
FIG. 9 is a simplified illustration of a modified embodiment of the electrical circuit shown in FIG. 6.

In FIG. 9 is shown a modified embodiment of the electrical circuit shown in FIG. 6. In the embodiment shown in FIG. 9, the stop switch SW2 is operated by an electrical circuit shown in FIG. 10.

Figure 10:
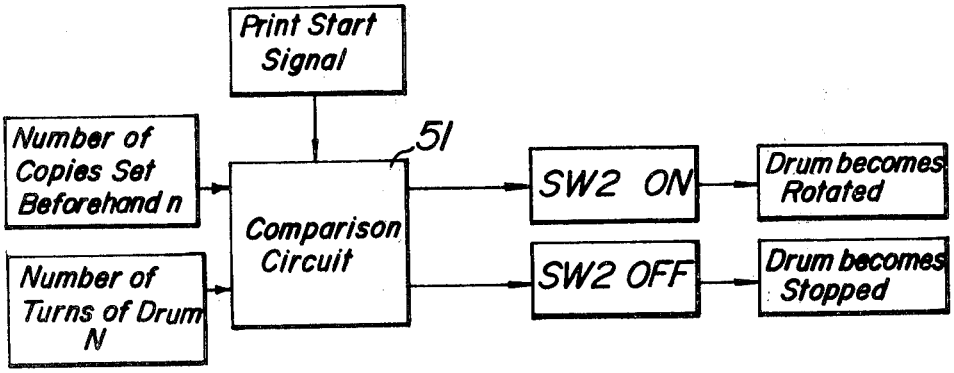
FIG. 10 is a block diagram showing an electrical circuit that may be used for operating a switch for stopping a photosensitive drum.

In the electrical circuit shown in FIG. 10, provision is made of a comparison circuit 51 having three input terminals and two output terminals. A print start signal is supplied to one of these input terminals and signals corresponding to number of copies set beforehand n and to number of turns N of the drum 47 are supplied to the two remaining input terminals. The comparison circuit 51 functions to compare the input signals corresponding to n and N such that if the nunber of turns N of the drum 47 is smaller than the number of copies set beforehand n plus 1, that is $N<n+1$, the stop switch SW2 is made ON so as to rotate the drum 47 and that if the number of turns N of the drum 47 becomes equal to the number of copies set beforehand n plus 1, that is, $N=n+1$, the stop switch SW2 is made OFF so as to stop the drum 47.

As seen from the above, the electrical circuit shown in FIG. 10 can also control the number of turns N of the drum 47 to the number of copies set beforehand n plus 1.

What is claimed is:

1. A device for controlling rotations of a photosensitive drum for electrographic apparatus, comprising means for setting number of copies to be reproduced to any desired number and composed of a dial; means for subtracting the rotated number of a photosensitive drum from the number of copies set beforehand by said dial and composed of a first ratchet wheel secured to a shaft of the dial, a claw engageable with a tooth of said first ratchet wheel and rotating said first ratchet wheel in a direction opposed to the rotating direction of said dial, and means including a solenoid and receiving a signal from a detection means, for detecting the number of turns of the photosensitive drum and operating said claw; means for rotating the photosensitive drum for two turns and then stopping it when the number of copies set beforehand becomes 1 and comprised of a second ratchet wheel freely engageable with said dial shaft and arranged in opposition to the first ratchet wheel, the said second ratchet wheel having two teeth and being urged against said first ratchet wheel so as to make the two teeth of said second ratchet wheel continuous with the teeth of said first ratchet wheel, said second ratchet wheel including first and second cams, said first cam being engaged with a pawl interlocked with a start switch and said second cam being engaged with a stop switch, whereby the rotation of said photosensitive drum causes a claw to engage with the first ratchet wheel when the dial is set to 2 or larger than 2 and causes said claw to engage with the second ratchet wheel when said dial is set to 1 so as to return said first and second cams to their original positions, thereby setting said stop switch to OFF position and stopping said photosensitive drum.

2. The device according to claim 1, wherein said means for rotating said photosensitive drum is composed of a clutch, a solenoid for operating said clutch and a relay circuit including a first switch and a second switch constituting a counter and being made OFF when the number of turns of said drum becomes equal to the number of copies set beforehand plus 1, said first and second switches being made ON in succession when said device is started to operate and energizing said relay circuit and said solenoid, whereby said drum is rotated for the number of turns which is equal to the number of copies set beforehand plus 1.

3. The device according to claim 2, wherein said second switch engages with said second cam and is made ON when said second cam is rotated and made OFF when said second cam is returned to its original position.

4. The device according to claim 2, wherein said second switch is connected to a comparison circuit which functions to compare the number of copies set beforehand n with the number of turns N of said drum such that said second switch becomes ON when $N<n+1$ and becomes OFF when $N=n+1$.

* * * * *